United States Patent [19]

Doty

[11] Patent Number: 4,601,077

[45] Date of Patent: Jul. 22, 1986

[54] TOOL FOR PROVIDING ACCESS TO UNDERGROUND VALVE STEMS

[76] Inventor: John T. Doty, 2238 E. 21st St., Long Beach, Calif. 90806

[21] Appl. No.: 722,360

[22] Filed: Apr. 12, 1985

[51] Int. Cl.[4] ..... B25F 1/00

[52] U.S. Cl. ..... 7/138

[58] Field of Search ..... 7/138, 142, 114, 158; 175/310, 323, 394; 15/104.3 R, 104.3 SN, 104.9; 299/87

[56] References Cited

U.S. PATENT DOCUMENTS

| | | | |
|---|---|---|---|
| 677,202 | 6/1901 | Gibbs | 175/394 |
| 1,569,787 | 1/1926 | Robertson | 175/394 |
| 2,880,968 | 4/1959 | Titeca | 175/394 |

FOREIGN PATENT DOCUMENTS

| | | | |
|---|---|---|---|
| 2480348 | 10/1981 | France | 175/323 |

*Primary Examiner*—Roscoe V. Parker

*Attorney, Agent, or Firm*—Evanns & Walsh

[57] ABSTRACT

A tool for obtaining access through a gate can to the end of a valve stem of a valve in a buried water main. The gate can extending from the valve bonnet to the surface may be filled with silt, dirt, or debris. The tool is cylindrical, having a helical rib and cutting edge providing an auger so that by turning the tool the debris within the gate can can be cut into and removed by the tool. The tool has a fitting at the top adapted to receive a socket on the end of a manual operating tool which is the same tool that can be used to engage a fitting on the end of the valve stem for operating the valve.

4 Claims, 5 Drawing Figures

Fig. 3
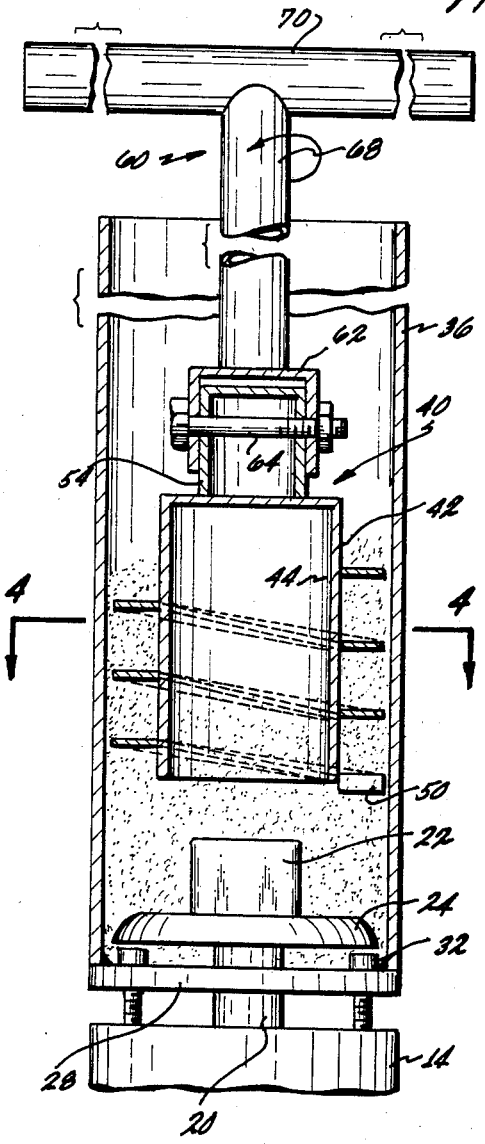
Fig. 5
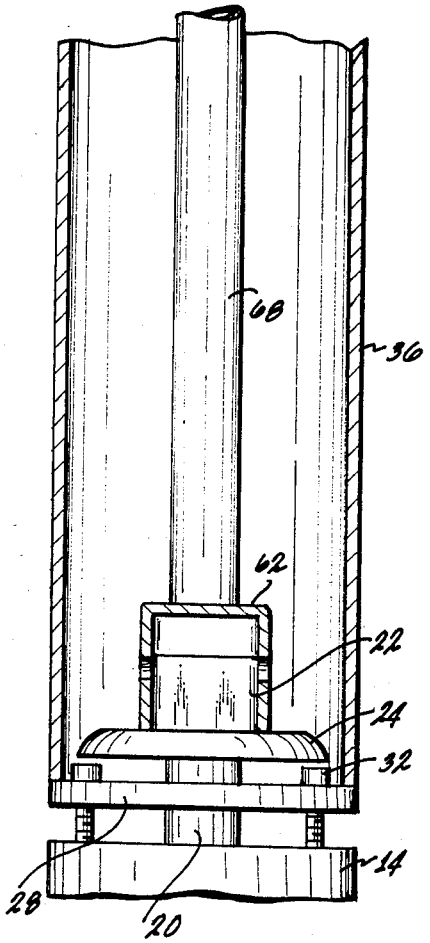
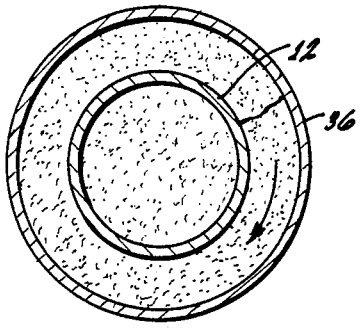
Fig. 4

TOOL FOR PROVIDING ACCESS TO UNDERGROUND VALVE STEMS

BACKGROUND OF THE INVENTION

1. Field of the Invention

The field of the invention is particularly related to the following. All water companies, large and small, have miles of water lines buried in the streets and right of ways in order to serve their customers. Included in these miles of pipelines there are hundreds, if not thousands, of valves, typically, gate valves to control the flow of water, in their systems. The valves are typically installed in pipelines that are buried from three to ten feet under the surface approximately. The herein invention is concerned primarily with that of gaining access to these valves with a tool, all as described more in detail hereinafter.

2. Description of the Prior Art

As set forth in the foregoing relating to the field of the invention, it is concerned with valves that are buried underground in water lines. Typically, these valves are gate valves, although there can be valves of other types. Typically, when these valves are installed, they are installed with a cylindrical enclosure called a gate can, the lower end of which is the same size as the valve bonnet and the other end of which extends to the surface and which is provided with a closure at the surface. By removing the closure or lid on the enclosure or gate can and using a special T-handled socket wrench or tool, a maintenance man can normally quickly gain access to the end of the valve stem of the buried valve and operate it to turn it on and off. This can be done provided that the enclosure, that is, the gate can, is not filled with silt, sand, road-base material, or other debris which prevents access to the operating end of the valve stem.

As well-known in the prior art, when a water line becomes broken, very serious damage can result from water gushing out of the break and flooding adjacent residences or other buildings, doing substantial damage to properties, such as rugs and other appurtenances. What happens frequently is that emergency crews have difficulty finding the valves and even greater difficulty obtaining access to the operating stems of the valves because the enclosures or gate cans become filled up, as described in the foregoing. Typically, great difficulty is experienced in digging out or extracting debris from the enclosure or gate can which, of course, delays the time before the emergency can be corrected, and the valve or valves are shut off to stop water coming out of the break.

The problem outlined in the foregoing has not been met or solved in the prior art in any way. The herein invention is concerned with this problem and provides a tool which is intended to meet the problem in a practical and efficient way, all as described in detail hereinafter.

SUMMARY OF THE INVENTION

In the preferred exemplary form of the invention as described herein, it is in the form of a tool having a cylindrical part having a bore. Typically, the size of the bore is in the range of six inches to twelve inches, depending of course upon the size of the water main and valve with which it is to be operated. On the outside of the cylindrical part of the tool is a helical rib of a diameter such that the rib will fit into the enclosure, that is, the gate can that is in position at the upper end of the valve and extending to the surface. At the lower end of the rib is a generally radial cutting edge which is substantially at the level of the bottom end of the cylindrical bore in the tool.

At the upper end of the tool is a fitting, typically a square nut of a size adapted to fit into a square socket at the end of an operating tool.

Typically, the valve in question, such as a buried gate valve, has an operating stem at the end of which is an operating fitting, typically in the form of a square nut which can receive a square socket at the end of an operating tool, which extends to the surface.

The tool, as stated, has a square fitting at the top which can receive the square socket at the end of an operating handle so that the tool can be turned so as to operate as an auger to dig out silt, dirt or other debris that is within the gate can, that is, the enclosure, between the operating end of the valve stem and the surface. The hollow end of the operating tool can come down over the operating nut at the end of the operating stem of the valve so that all of the debris can be removed providing for free and ready access to the nut at the end of the operating stem for the operating tool. Thus, it can be seen that the problem, with the tool as described herein, can quickly and readily be met, that is, the debris in the gate can or enclosure can quickly be gotten out to allow access to the stem of the valve for operating it.

In light of the foregoing, the primary object of the invention is to provide, or make available, a unique tool to achieve the capability as described in the foregoing of providing access to the operating stems of buried valves which normally have an enclosure or gate can extending between the end of the stem and the surface and which can and do become filled with silt, dirt or other debris preventing access to the operating stem.

A further object is to provide a tool as in the foregoing which includes a central member carrying a helix which provides an auger so that the tool can operate as an auger to dig into and remove the debris that is in a position between the top of the end of the valve stem and the surface to allow access to the operating stem.

A further object is to provide a tool as in the foregoing which is in the form of a cylinder having a bore of a predetermined diameter with a helical rib on the outside of the cylinder forming an auger which has a diameter corresponding to the interior diameter of the gate can or enclosure which typically is in a position between the top end of the operating stem of the valve and the surface, whereby debris within the said enclosure can be dug away and removed to provide access to the valve stem.

BRIEF DESCRIPTION OF THE DRAWINGS

FIG. 3 is a cross-sectional view of the end of the valve stem, the gate can and the tool in position within the gate can;

FIG. 4 is a cross-sectional view taken along the line 4—4 of FIG. 3;

FIG. 5 is a cross-sectional view of the end of a valve stem with a fitting at its end, the lower part of the gate can, and the lower part of the manual operating handle.

DESCRIPTION OF A PREFERRED EMBODIMENT AND BEST MODE OF PRACTICE OF THE INVENTION

Figure 1:
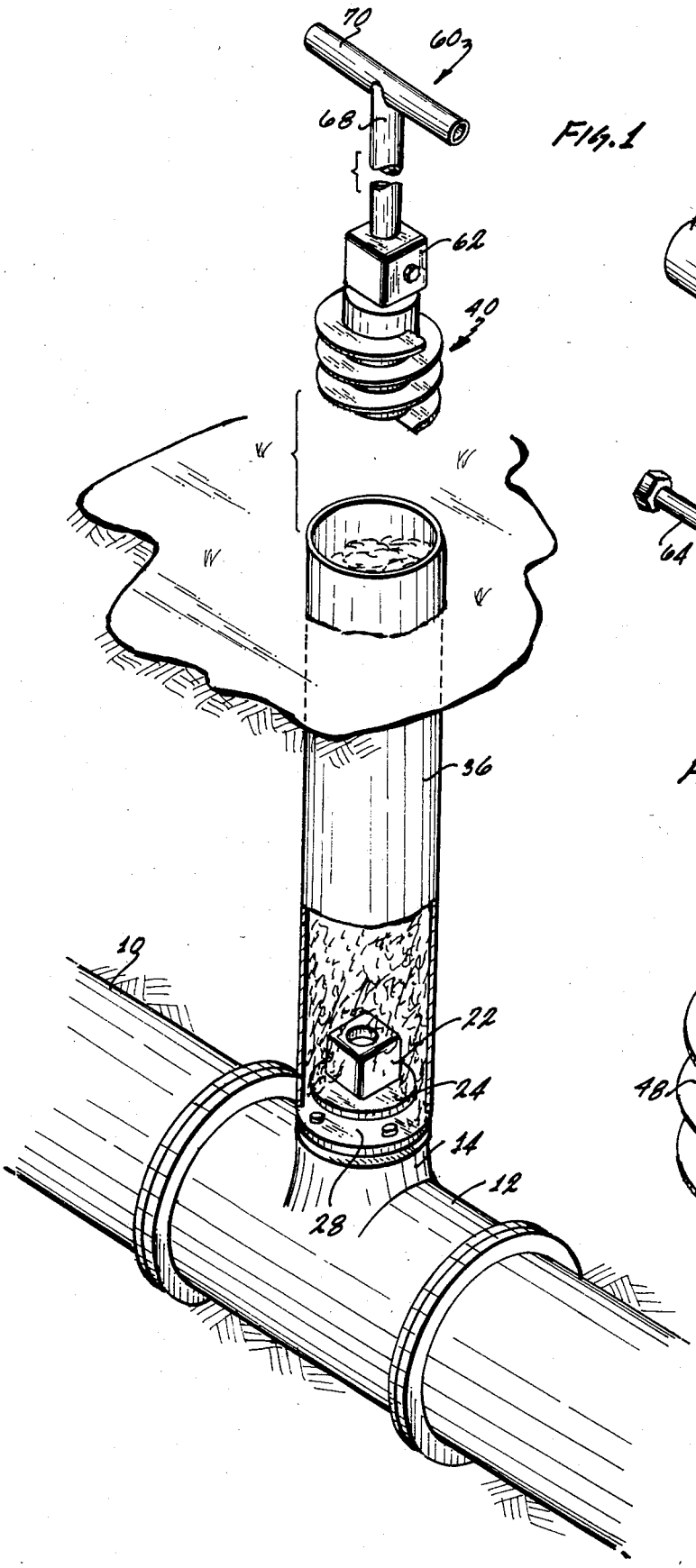
FIG. 1 is a pictorial view illustrating a preferred form of the invention and its utilization.

Referring to the drawings, FIG. 1 is a pictorial view showing a buried water pipeline 10, valve and gate can. The line has a section 12 which has a valve in it which in the present embodiment is a gate valve, the valve having a bonnet 14. The valve has a stem 20 as may be seen in FIGS. 3 and 5 at the upper end of which is a square fitting 22 above a disc 24 which is at the end of the stem 20 and underneath the square part 22. Numeral 28 designates a disc spaced from the valve bonnet 14 and which is attached to the bonnet or the top of the valve by cap screws or bolts, such as shown at 32. Normally, a gasket or a sealing member is provided between the top of the valve bonnet and the disc 28 (not shown).

The gate can or enclosure is identified by numeral 36, as shown in the figures. The lower end of it comes down over the disc 28 and may be secured to it by welding. This enclosure, as shown, is normally cylindrical and extends to the surface, and the top end is normally closed by a removable enclosure or cap (not shown). As described in the foregoing, frequently the gate can or enclosure 36 becomes filled with silt, dirt, or other debris so that access cannot be had to the fitting 22 which is a square fitting adapted to receive a square socket at the end of an operating handle, as will be described.

Figure 2:
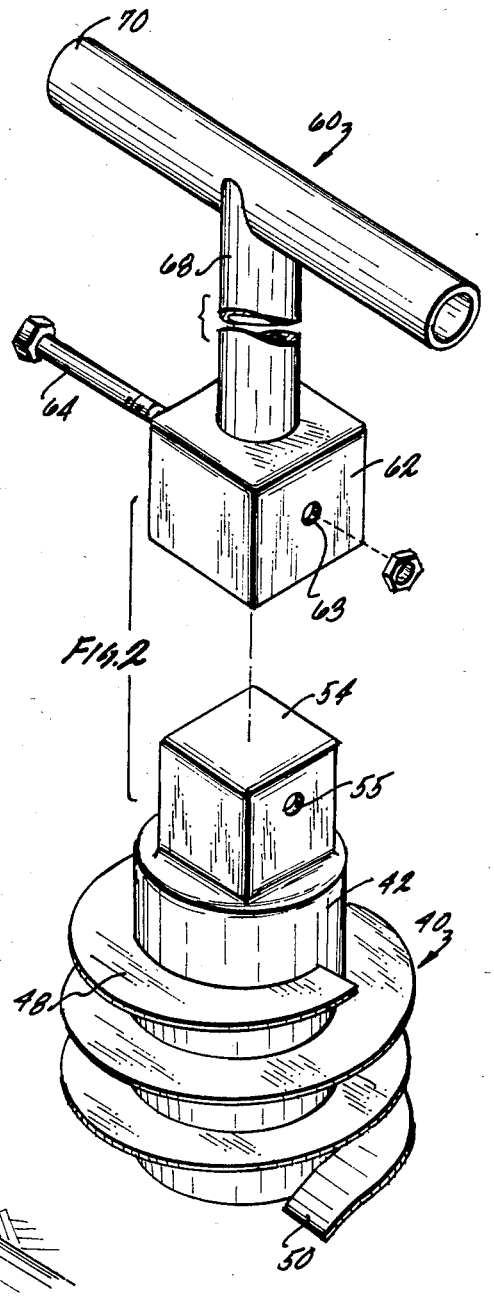
FIG. 2 is an isometric view of the tool and a handle with a fitting for turning it.

The tool is identified generally by the numeral 40 in FIGS. 1, 2, and 3. The tool includes a central cylindrical part 42 which has a bore 44 of a size such that it can come down over the fitting 22, as may be seen in FIG. 1. Formed on the outside of this cylindrical part 42 is a helical rib 48. At the lower end of the rib 48 is a cutting edge 50 which is in substantially a radial position and at the bottom end of the cylindrical part 42. At the top of the cylindrical part 42 is a square fitting 54 which is of a size to be received in a square socket at the end of an operating handle, as will be described. The fitting 54 has a transverse bore through it, as designated at 55.

Numeral 60 designates a generally a manual actuating or operating tool. At its lower end, it has a square socket 62 of a size to be received over the fitting 54 at the upper end of the tool and also the fitting 22 at the upper end of the valve stem. The socket 62 has a transverse bore 63, and numeral 64 designates a bolt that can fit through the bores 63 and 55 when the socket 62 is in position over the fitting 54, as may be seen in FIG. 3.

Numeral 68 designates a stem extending vertically from the socket 62 having at its upper end the transverse operating handle 70. The stem 68 may be of any desired length.

FIG. 3 is a cross-sectional view showing the operating handle in position with the square socket 62 over the fitting 54 at the upper end of the tool 40 and bolted to it by the bolt 64. In FIG. 3, the closure or cap at the top end of the gate can 36 has been removed. This figure shows the tool in operating position. The tool is turned by hand by the operating handle at 70 so that the helix or auger 48 can cut into the silt, dirt, or other debris in the gate can. The tool can, of course, be lifted out of the gate can, carrying with it at the same time dirt or debris that has been loosened and is carried in between the convolutions of the helix as the tool is operated, and the debris within the gate can is removed. The tool, of course, moves downwardly in the enclosure, and when most or all of the debris has been removed, the lower end of the cylinder 42 will come down over the fitting 24, and the tool can then be removed entirely, and the operating handle 60 can be disengaged from the tool. Then, the operating tool 60 can have the stem 68 and the fitting, that is, the socket 62, extended down so that the socket fits over the fitting, that is, the square fitting 22, at the upper end of the valve stem 20. The valve can then be readily operated by the operating tool 60, either by way of closing it or opening it.

From the foregoing, those skilled in the art will readily understand the nature of the invention and the construction and operation of the tool and its utility. Those skilled in the art will readily recognize and appreciate the manner in which the tool achieves all of the objectives as set forth in the foregoing.

The foregoing disclosure is representative of a preferred form of the invention and is to be interpreted in an illustrative rather than a limited sense, the invention to be accorded the full scope of the claims appended hereto.

What is claimed is:

1. As an article of manufacture, a tool constructed for gaining access to a valve operating stem having an operating fitting at the end of an underground valve having a circular enclosure surrounding the operating end of the valve stem and extending to the surface, the tool being in the form of a cylinder having a bore of a size to be received over the operating fitting at the operating end of the valve stem, a helical rib for providing an auger formed on the outside of the said cylinder and of a size to fit within the enclosure, the tool having a fitting at one end to receive a corresponding fitting at the end of an operating member, the said helical rib having the capability, when rotated, to cut into debris within the enclosure whereby to remove the debris so that access can be had to the operating fitting at the end of the valve operating stem.

2. A tool as in claim 1 wherein said helical rib is provided with a cutting edge at its bottom end, extending substantially in a radial direction at substantially the end of the bore in the tool whereby to cut into the debris around the fitting at the operating end of the valve stem.

3. As an article of manufacture, a tool constructed for gaining access to a valve operating stem of an underground valve, the stem having an operating fitting at the end, the underground valve having a circular enclosure surrounding the operating end of the valve stem and extending to the surface, the tool being in the form of a cylinder having an end part having a bore of a size to be received over the operating fitting at the operating end of the valve stem, the tool having a helical rib around the central axis of the tool and of a size to fit within the enclosure, the tool having a fitting at one end to receive a corresponding fitting of an operating member, the said helical rib having a capability when rotated to cut into debris within the enclosure whereby to remove the debris so that access can be had to the operating fitting at the end of the valve operating stem.

4. A tool as in claim 3 wherein the said helical rib is provided with a cutting edge at the bottom end extending substantially in a radial direction at substantially the bottom end of the tool whereby to cut into the debris within the said enclosure.

* * * * *